US008992353B1

(12) United States Patent
Kortegast

(10) Patent No.: US 8,992,353 B1
(45) Date of Patent: Mar. 31, 2015

(54) ILLUMINATED ROLLING GAME BALL

(71) Applicant: Bede Kortegast, Seattle, WA (US)

(72) Inventor: Bede Kortegast, Seattle, WA (US)

( * ) Notice: Subject to any disclaimer, the term of this patent is extended or adjusted under 35 U.S.C. 154(b) by 0 days.

(21) Appl. No.: 14/022,895

(22) Filed: Sep. 10, 2013

Related U.S. Application Data

(60) Provisional application No. 61/698,828, filed on Sep. 10, 2012.

(51) Int. Cl.

| | |
|---|---|
| ***A63B 43/06*** | (2006.01) |
| ***F21L 4/02*** | (2006.01) |
| ***F21V 33/00*** | (2006.01) |
| ***F21K 99/00*** | (2010.01) |

(52) U.S. Cl.
CPC . *A63B 43/06* (2013.01); *F21K 9/30* (2013.01); *F21L 4/02* (2013.01); *Y10S 362/80* (2013.01)
USPC ..... 473/570; 362/234; 362/800

(58) Field of Classification Search
USPC ..... 473/570, 571, 594, 595, 600; 362/234, 362/253, 363, 800, 806
See application file for complete search history.

(56) References Cited

U.S. PATENT DOCUMENTS

| | | | | |
|---|---|---|---|---|
| 3,229,976 | A * | 1/1966 | Allen, Jr. | 473/570 |
| 4,776,589 | A * | 10/1988 | Yang | 473/570 |
| 5,066,012 | A * | 11/1991 | Stark | 473/570 |
| 5,102,131 | A * | 4/1992 | Remington | 473/570 |
| 5,186,458 | A * | 2/1993 | Redondo | 473/570 |
| 5,236,383 | A * | 8/1993 | Connelly | 446/219 |
| 5,609,411 | A * | 3/1997 | Wang | 362/234 |
| 5,669,702 | A * | 9/1997 | Wang | 362/234 |
| 5,725,445 | A * | 3/1998 | Kennedy et al. | 473/570 |
| 7,014,581 | B2 * | 3/2006 | Ng | 473/570 |
| 8,231,246 | B2 * | 7/2012 | Chien | 362/253 |
| 8,517,870 | B2 * | 8/2013 | Crowley et al. | 473/570 |
| 8,663,040 | B2 * | 3/2014 | Kortegast | 473/570 |
| 2003/0133311 | A1 * | 7/2003 | Robertson et al. | 362/806 |
| 2003/0224885 | A1 * | 12/2003 | Leal et al. | 473/570 |
| 2006/0135297 | A1 * | 6/2006 | Cruciani | 473/570 |
| 2007/0021244 | A1 * | 1/2007 | Ko | 473/570 |
| 2007/0281811 | A1 * | 12/2007 | Wang | 473/570 |
| 2014/0031151 | A1 * | 1/2014 | Crowley et al. | 473/570 |

* cited by examiner

*Primary Examiner* — Steven Wong
(74) *Attorney, Agent, or Firm* — Dean A. Craine

(57) ABSTRACT

An improved LED illuminated rolling game ball designed to use three AAA batteries. The ball includes a plastic, opaque spherical body with an axially aligned bore in which a multiple LED light assembly extends. The light assembly includes an outer tube, an intermediate sleeve, a multiple AAA battery holder, a multiple LED bulb holder, one switch cap and one end cap. In one embodiment, outer tube is a solid structure made of electrical conductive material includes two opposite end openings that connect to the switch and end caps that hold the outer tube in place in the bore. LED bulb holes are formed on the outer tube. The intermediate sleeve is located inside the outer tube and the battery holder is located inside the intermediate sleeve. The LED bulb holder includes a PCB with two or more LED bulbs arms that hold the LED bulbs outward through the bores formed on the outer tube.

6 Claims, 7 Drawing Sheets

ILLUMINATED ROLLING GAME BALL

This utility patent application is based upon and claims the filing date benefit of U.S. provisional patent application (Application No. 61/698,828) filed on Sep. 10, 2012.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to game equipment and more particularly, to game equipment that includes a ball rolled across the ground to a target or location and contacts other balls or objects.

2. Description of the Related Art

Bocce ball is a popular game in which opposing players or teams attempt to roll a ball assigned to them to a position closer to a smaller target ball than the ball tossed by an opposing player or team. The game which is played in multiple rounds, which requires players take turns tossing and rolling their balls at the smaller target ball typically located 30 to 70 feet away. At the end of each round, the player who tosses the closest ball or balls to the target ball is awarded one or more points. The rounds are repeated until a player or team obtains the designated points needed to win the game, typically 10 or 15 points.

Recently, illuminated bocce balls have been developed that enable them to be visible at night or in dark environments from a distance of 30 to 70 feet. U.S. Pat. Nos. 6,575,855, 6,712,721 and 6,723,013 each disclose a day and night croquet or bocce ball that uses a chemo-luminescent stick inserted into a bore that partially extends into the ball.

More recently, an battery energized illuminated bocce ball is disclosed in U.S. Utility patent application Ser. No. 13/546,396, ('396 Application) filed on Jul. 11, 2012, which is incorporated by reference herein. The illuminated bocce ball disclosed in the '396 Application uses an illuminated cap assembly axially aligned and partially extends into the ball's spherical body. The illuminated cap assembly includes an outer housing, and intermediate assembly, and a lower inner housing. Mounted on the intermediate assembly is a PCB with a multi-functional switch and a longitudinally aligned plunger. The intermediate assembly also includes a downward extend bridle with a downward extending LED bulb. Located inside the bridle is a plurality of stacked watch batteries.

One problem with the LED illuminated bocce ball disclosed in the '396 Application referenced above it uses watch batteries that are difficult to replace in the dark and relatively expensive. What is needed is an improved LED illuminated bocce ball configured to use standard, inexpensive AAA batteries that are easy to replace. In addition, because only LED bulb is use, the illumination of the ball is reduced.

SUMMARY OF THE INVENTION

Designed herein is an improved LED illuminated rolling game ball designed to use three standardize AAA batteries. The ball includes a plastic, translucent or transparent spherical body with an axially aligned bore in which a multiple LED bulb light assembly is extended. The multiple LED bulb light assembly includes an outer tube, a cylindrical intermediate sleeve, a multiple AAA battery holder, a multiple LED bulb holder, a switch cap and an end cap. The outer tube, which is made of electrical conductive material in one embodiment, includes two opposite end openings that selectively connect to the switch and end caps that close the ends of the bore to create a watertight seal and also securely hold the outer tube in place in the ball.

Located inside the outer tube is the intermediate sleeve and located inside the intermediate sleeve is the multiple AAA battery holder. The multiple LED bulb holder includes a PCB with two or more LED arms. During assembly, the multiple AAA battery holder is placed inside the intermediate sleeve and the PCB is positioned transversely inside the outer tube and against one end of the intermediate sleeve and the battery holder. The LED arms on the multiple LED bulb holder extend inward and positioned in gutters formed in the intermediate sleeve which hold the LED bulbs through the bores formed on the outer tube.

When the outer tube is made of metal, the outer tube acts as an electrical conductor extending between a switch mounted on the switch cap and the PCB mounted on the multiple LED assembly. In another embodiment, the outer tube is made of non-conductive material, (ie. plastic, nylon, paper, etc) with a dual ring connector assembly located therein that acts as a conductor between the switch and the PCB.

After assembly, the multiple LED light assembly is coaxially aligned inside the bore formed on along the spherical body's axis. In the embodiment presented herein, the multiple LED bulb light assembly includes three LED bulbs radially aligned around the axis creating a spherical ball that glows uniformly in all directions and is balanced so it does not wobble when rolled. It should be understood, however, that the invention is not limited to three LED bulbs. Also, the outer surface of the spherical ball is smooth and uniform enabling it to roll accurately. When the batteries are discharged, the battery holder may be easily removed from the intermediate member an the three AAA batteries may be easily replaced.

DESCRIPTION OF THE PREFERRED EMBODIMENT(S)

Figure 1:
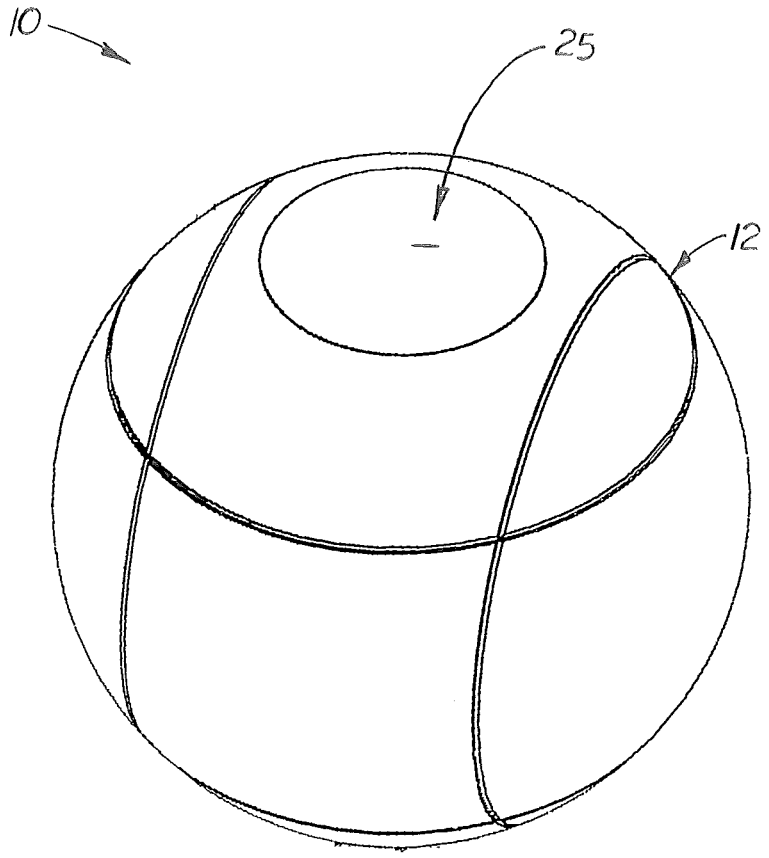
FIG. 1 is a perspective view of an improved LED illuminated rolling game ball.

Referring to the Figs, there is shown an improved LED illuminated rolling game ball 10 designed to use three standardize, inexpensive AAA batteries 150. The ball 10 includes a plastic, translucent or transparent spherical body 12 in which a multiple LED bulb light assembly 25 is axially aligned and extends through the spherical body 12. Mounted on the sides of the LED light assembly 25 are at least two or more laterally extending LED bulbs 98. The spherical body 12 is sufficiently translucent and the LED bulbs 98 are sufficiently bright and uniformly positioned inside the ball 10 so that when the LED bulbs 98 are activated, the entire spherical body 12 glows uniformly.

Figure 2:
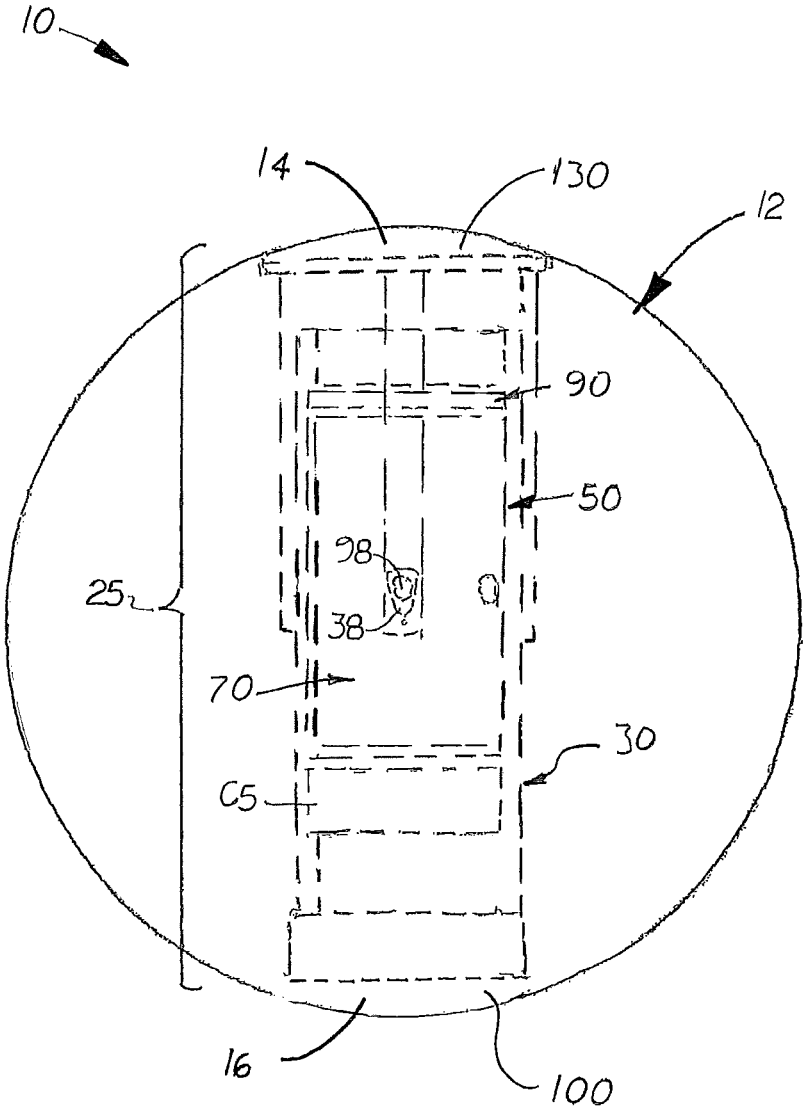
FIG. 2 is a side elevational view of the ball shown in FIG. 1.
Figure 3:
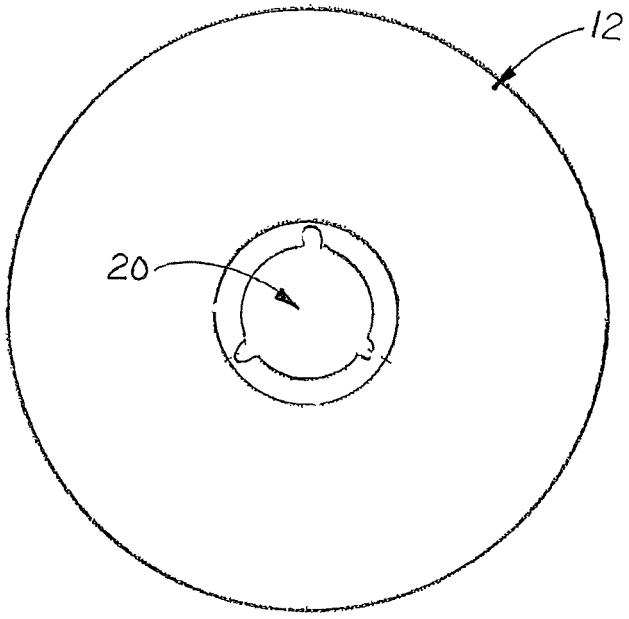
FIG. 3 is a top plan view of the spherical ball body.
Figure 4:
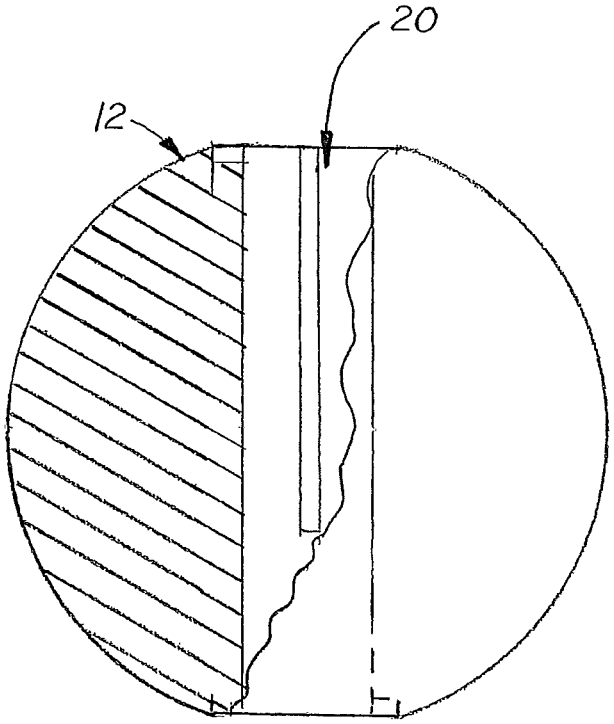
FIG. 4 is a sectional side elevational view of the spherical ball body.
Figure 5:
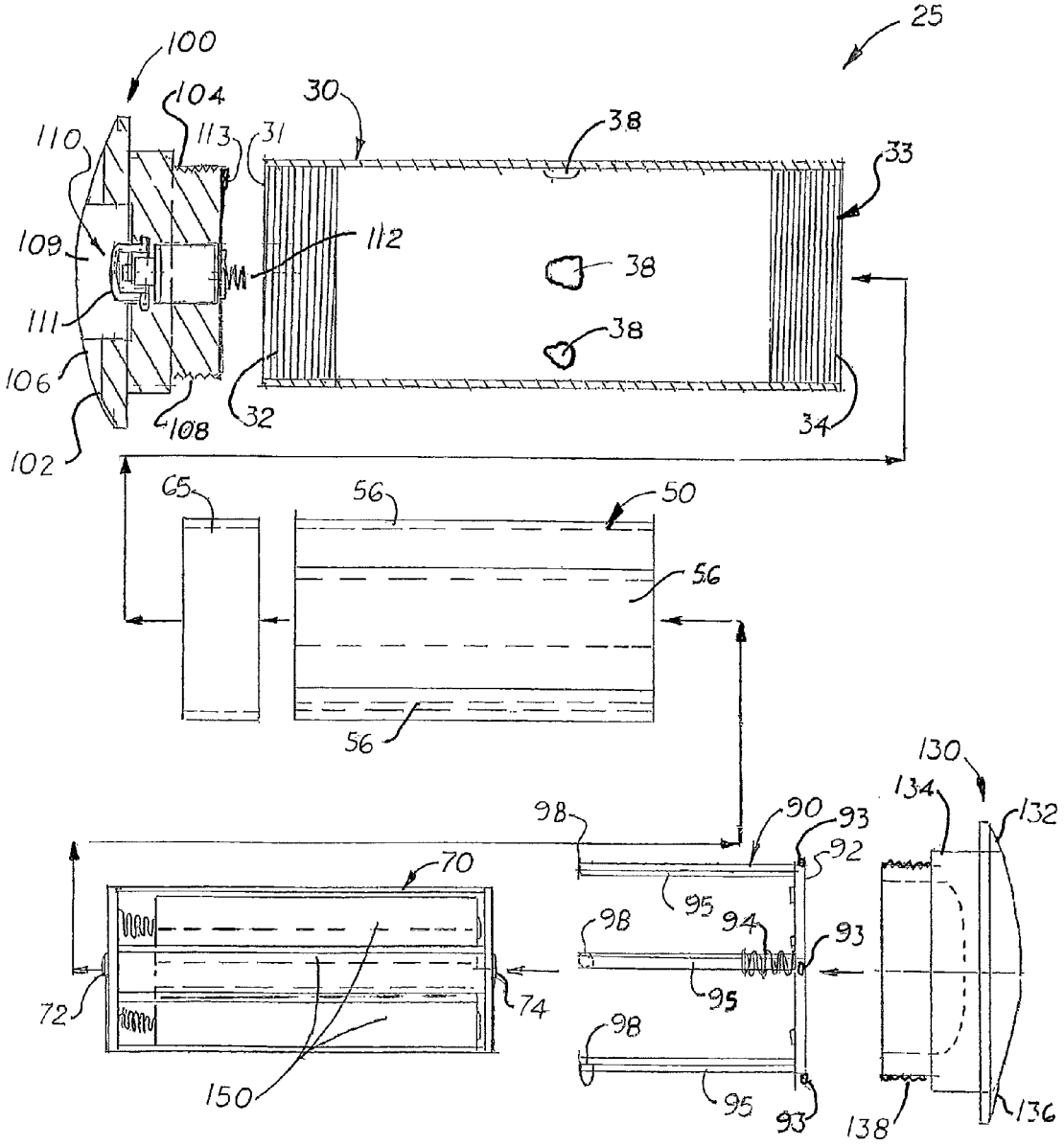
FIG. 5 is an exploded said elevational view of the multiple LED light assembly.
Figure 6:
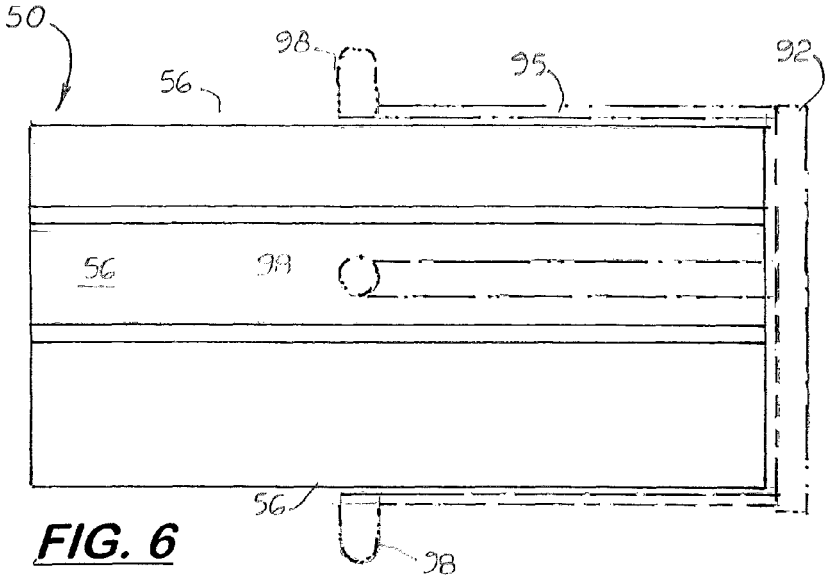
FIG. 6 is a side elevational view of the intermediate sleeve showing the location of the LED arms in the gutters formed on the intermediate sleeve.
Figure 7:
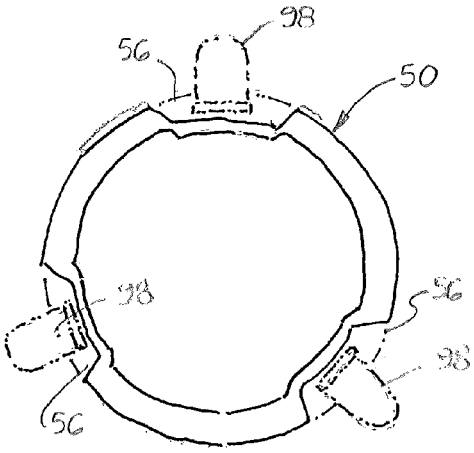
FIG. 7 is a sectional view taken along line 7-7 in FIG. 6.
Figure 8:
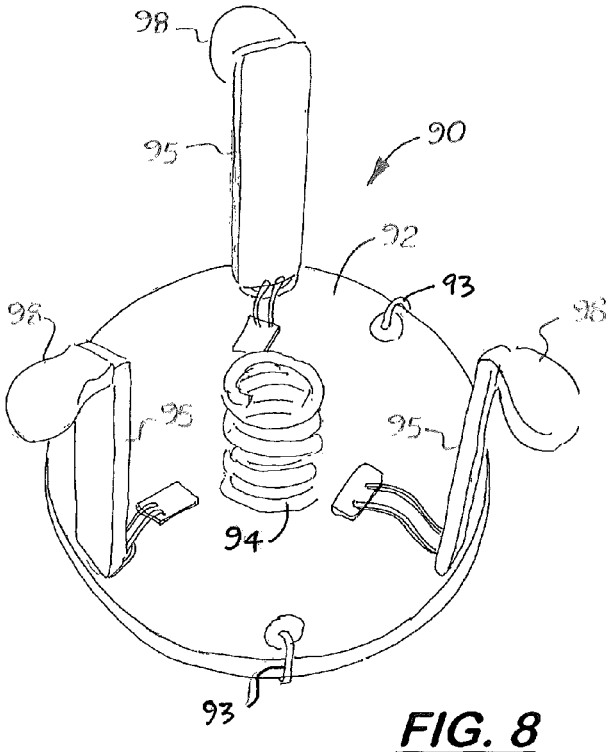
FIG. 8 is a perspective view of the multiple LED bulb holder.

The multiple LED light assembly 25, shown more clearly in FIGS. 2 and 5 includes an outer tube 30, a cylindrical intermediate sleeve 50, a multiple AAA battery holder 70, a multiple LED bulb holder 90, a switch cap 100 and an end cap 130. The outer tube 30 is cylindrical with two opposite end openings 31, 33 each with internal threads 32, 34, respectively, formed thereon. Formed on the sides of the outer tube 30 near the tube's mid-line axis are at least two small holes 38 each configured to receive an LED bulb 98 mounted on the multiple LED bulb holder 90 discussed further below. In one embodiment, the outer tube 30 is made of electrical conductive material which enables the outer tube 30 to act as an electrical conduit between the switch cap 100 that attaches to the end opening 31 on the outer tube 30 and the contacts on the printed circuit board 92 (PCB) mounted on a multiple LED bulb holder 90 that is inserted into the opposite end opening 33 on the outer tube 30.

Both caps 100, 130 are attached to the opposite end openings 31, 33 on the outer tube 30. Both caps 100, 130 are T-shaped and include a top flange plate 102, 132, respectively, that presses against a recessed receiving cavity 14, 16, respectively, formed on the spherical body 12 and coaxially aligned with axially aligned bore 20, (see FIG. 2). Both caps 100, 130 also include a perpendicularly aligned cylinder neck 104, 134, respectively, that extends into the end openings 31, 33, respectively. Each top flange plate 102, 132 includes an outer curved surface 106, 136, respectively, that matches the adjacent curve surfaces on the spherical body 12 surrounding the end openings 31, 33, respectively, on the axially aligned bore 20 to form a continuously spherical ball body 12 that rolls evenly in any direction. The neck 104, 143 on each cap 100, 130, respectively, includes external threads 108, 138, respectively, that the engage internal threads 32, 34 on the opposite end openings 31, 33, respectively, on the outer tube 30.

As shown in FIG. 5, the switch cap 100 includes a recessed outer cavity 109 with a momentary switch 110 mounted therein. The momentary switch 110 includes a plunger style button 111 partially concealed and extends outward into the recessed outer cavity 109. The momentary switch 110 is connected to a spring-loaded battery connector 112 that extends inward from the inside surface of the switch cap 100 and into the outer tube 30 and contacts the main battery contact 72 on the battery holder 70 discussed further below. The momentary switch 110 also includes at least one electrical contact 113 that connects to the outer tube 30.

The intermediate sleeve 50 is slightly smaller in diameter and shorter in length than the outer tube 30. The intermediate member 50 is also configured to slide inside the outer tube 30 and extend around the battery holder 70. When properly assembled, the intermediate sleeve 50 holds the battery holder 70 in a fixed position inside the outer tube 30. The intermediate sleeve 50 includes two or more longitudinally aligned recessed gutters 56. The gutters 56 are formed on the intermediate sleeve's outer surface and configured to receive a LED arm 95 on the multiple LED bulb holder 90 discussed further below. During assembly, the LED arms 95 slide over the gutters 56. The intermediate sleeve 50 is then inserted into the outer tube 30 so that the gutters 56 support and hold the LED arms 95 outward and against the inside surface of the outer tube 30. The gutters 56 are sufficiently deep so an LED bulb 98 attached to the distal end of each arm 95 is forced outward through a LED bore 38 formed on the outer tube 30. A cylindrical ring spacer 65 may be placed inside the outer tube 30 to hold the intermediate sleeve 30 in position.

The battery holder 70 is configured to hold three longitudinally aligned AAA batteries 150 connected in a series to two battery contacts 72, 74 mounted on opposite ends of the battery holder 70. When the battery holder 70 is placed inside the outer tube 30, the contacts 72 and 74 are exposed and configured to connect to the contacts 112, 94 on the switch cap 100 and the multiple LED bulb holder 90, respectively.

Also mounted inside the outer tube 30 and longitudinally aligned with the battery holder 70 is a multiple LED bulb holder 90. As shown in FIGS. 5-8, the multiple LED bulb holder 90 includes a circular printed circuit board 92 (PCB) with two or more LED arms 95 attached thereto. In the embodiment shown in the Figs, three LED arms 95 and three LED bulbs 98 are used. The LED arms 95 are perpendicularly aligned and mounted on the perimeter edge of the PCB 92. The PCB 92 is configured to fit tightly against the end opening 33 of the outer body 30. Formed near the perimeter edge of the PCB 92 are electrical contacts 93 that connect to the edge of the outer tube 30. Mounted coaxially and extending inward from the PCB 92 is a perpendicularly aligned, spring loaded electrical contact 94 that contacts to a lower battery connector 74 on the battery holder 70.

Attached to the distal end of each arm 95 is an outward extending LED bulb 98. The arms 95 are made of rigid, semi flexible material that enable them to extend inward and into a gutter 56 formed on the intermediate sleeve 50. As discussed above, the gutters 56 then force the LED bulbs 98 outward and through the bulb bores 38 formed on the outer tube 30.

The contacts 72, 74 on the battery holder 70 extend between electrical contacts 94, 112 on the PCB 92 and the momentary switch 110, respectively. The momentary switch 110 includes contacts 113 that connect to the outer tube 30. When the momentary switch 110 is closed, the electrical circuit between the batteries 150 and the LED bulbs 98 is closed thereby activating the LED bulbs 98. When the momentary switch 110 is opened, the circuit between the batteries 150 and the LED bulbs 98 is opened, thereby deactivating the bulbs 98.

Figure 9:
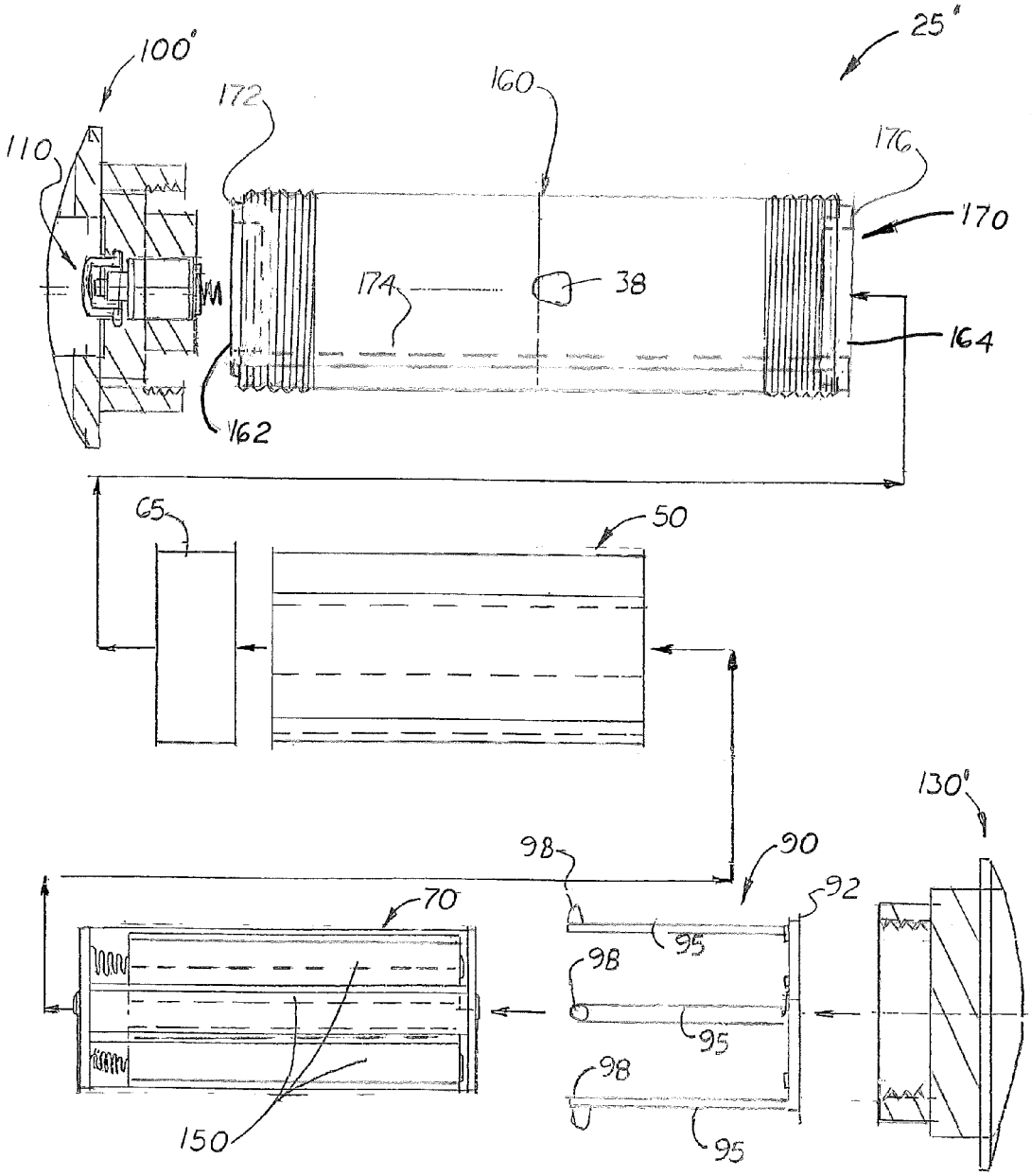
FIG. 9 is an exploded said elevational view of an alternative embodiment of the multiple LED light assembly in which the metallic outer tube is replaced by a non-metallic outer tube with a double ring connector located inside the plastic tube and with two sets of external threads manufactured on its opposite ends the engage internal threads manufactured on the switch cap and on the end cap.
Figure 10:
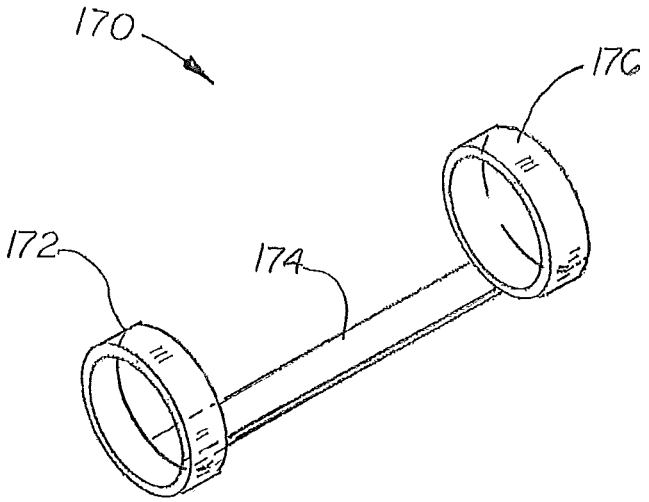
FIG. 10 is a perspective view of the double ring connector used in the alternative embodiment.

FIG. 9 is an exploded said elevational view of an alternative embodiment of the multiple LED light assembly, denoted as 25' in which the metallic outer tube 30 is replaced by an outer sleeve 160 made of non electrical conductive material, (such as plastic, nylon, glass, or paper) with a double ring connector assembly 170 located inside the outer sleeve 160. As shown in FIG. 10, the double ring connector assembly 170 includes two metallic rings 172, 176 and a longitudinally aligned conductive strip 174 that extends between the two rings 172, 176. The metallic rings 172, 176 are positioned on the opposite end openings 162, 164 of the outer sleeve 160 and contact the modified switch cap 100' with a modified momentary switch 110', respectively. The modified switch cap 100' includes a circular groove configured to partially receive the edge of the outer tube 160. A modified end cap 130' is also used with a modified neck with internal threads the engage threads on the outer tube 160.

After assembly, the momentary switch 110 is used to activate the three LED bulbs 98. Because the button 111 is located inside the outer cavity 109 and partially concealed, the button 111 is not pressed when the ball 10 contacts the ground or other balls. When the batteries 150 are discharged and need to be replaced, the end cap 130, 130' can be easily removed thereby enabling the battery holder 70 to be removed from the bore 20. The discharged batteries 150 can then be removed and replaced with fully charged batteries 150. The battery holder 70 is then inserted into the bore 20 and the end cap 130 or 130 is reattached.

In compliance with the statute, the invention described herein has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An improved LED illuminated rolling ball, comprising:

a. a plastic, translucent spherical body with an axially aligned bore;

b. an outer tube axially aligned inside said bore, said outer tube includes a cylindrical outer body with two end openings and a plurality of LED bulb holes formed thereon;

c. a cylindrical intermediate sleeve coaxially aligned and mounted inside said outer tube;

d. a multiple AAA battery holder located inside said intermediate sleeve, said battery holder contains three parallel, longitudinally aligned AAA batteries, said batteries are connected together in series inside said battery holder, said battery holder includes an upper electrical contact and a lower electrical contact;

e. a multiple LED bulb holder mounted inside said outer tube, said bulb holder includes a PCB with two or more LED arms, each said LED arms includes a perpendicularly aligned LED bulb, said PCB being positioned transversely inside said outer tube and coaxially aligned with and position adjacent to said intermediate sleeve, said LED arms extend into said outer tube and over said intermediate sleeve so said LED bulbs are aligned and maintained in said LED bulb holes, said PCB includes two electrical contacts;

f. a switch cap attached to said outer tube and disposed over said bore, said switch cap includes a switch with one pole electrically connected to said battery holder and a second contact that connects to said outer tube; and, g. an end cap attached to the end of said outer tube opposite said switch cap and disposed over said bore.

2. The rolling ball, as recited in claim 1, wherein said outer tube is made of electrically conductive material configured to complete an electrical circuit between said switch and said PCB.

3. The rolling ball, as recited in claim 1, wherein said outer tube includes two rings each made of electrically conductive material connected together.

4. An light assembly for an illuminated rolling ball, comprising;

a. an outer tube configured to fit into a bore formed along the mid-line axis of a rolling ball, said outer tube includes a cylindrical outer body with two end openings and a plurality of LED bulb holes formed thereon;

b. a cylindrical intermediate sleeve coaxially aligned and mounted inside said outer tube;

c. a multiple AAA battery holder located inside said intermediate sleeve, said battery holder contains three parallel, longitudinally aligned AAA batteries, said batteries are connected together in series inside said battery holder, said battery holder includes an upper electrical contact and a lower electrical contact;

d. a multiple LED bulb holder mounted inside said outer tube, said bulb holder includes a PCB with two or more LED arms, each said LED arms includes a perpendicularly aligned LED bulb, said PCB being positioned transversely inside said outer tube and coaxially aligned with and position adjacent to said intermediate sleeve, said LED arms extend into said outer tube and over said intermediate sleeve so said LED bulbs are aligned and maintained in said LED bulb holes, said PCB includes two electrical contacts; and, f. a switch cap attached to said outer tube, said switch cap includes a switch with one pole electrically connected to said battery holder and a second contact that connects to said outer tube.

5. The rolling ball, as recited in claim 4, wherein said outer tube is made of electrically conductive material configured to complete an electrical circuit between said switch and said PCB.

6. The rolling ball, as recited in claim 4, wherein said outer tube includes two rings each made of electrically conductive material connected together.

* * * * *